US006196809B1

(12) United States Patent
Takahashi et al.

(10) Patent No.: US 6,196,809 B1
(45) **Date of Patent: *Mar. 6, 2001**

(54) TWO-STAGE CENTRIFUGAL COMPRESSOR

(75) Inventors: Kazuki Takahashi; Haruo Miura; Hideo Nishida; Naohiko Takahashi; Yasuo Fukushima, all of Ibaraki-ken (JP)

(73) Assignee: Hitachi, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/023,686

(22) Filed: Feb. 13, 1998

(30) Foreign Application Priority Data

Mar. 19, 1997 (JP) ..... 9-066080

(51) Int. Cl.[7] ..... F04B 23/00; F04B 36/04

(52) U.S. Cl. ..... 417/243; 417/360; 417/365; 417/423.5; 417/423.14; 415/209.2

(58) Field of Search ..... 417/243, 350, 417/365, 373, 423.5, 423.8, 423.12, 423.14; 415/199.2, 199.3, 208.2, 209.2, 189, 190, 191

(56) References Cited

U.S. PATENT DOCUMENTS

| | | | | |
|---|---|---|---|---|
| 2,660,384 | * | 11/1953 | Smith | 417/350 |
| 2,865,299 | * | 12/1958 | Hornschuch et al. | 415/199.2 |
| 3,801,217 | * | 4/1974 | Ryall et al. | 415/199.2 |
| 3,912,000 | | 10/1975 | Nyeste . | |
| 4,125,345 | * | 11/1978 | Yoshinaga et al. | 417/243 |
| 4,288,204 | * | 9/1981 | Viertler | 417/243 |
| 4,614,482 | * | 9/1986 | Gaffal | 417/373 |
| 4,969,803 | * | 11/1990 | Turanskyj | 417/350 |
| 5,248,239 | * | 9/1993 | Andrews | 417/365 |
| 5,795,138 | * | 8/1998 | Gozdawa | 417/243 |
| 5,857,348 | * | 1/1999 | Conry | 417/423.12 |
| 5,888,053 | * | 3/1999 | Kobayashi et al. | 417/244 |

FOREIGN PATENT DOCUMENTS

| | | |
|---|---|---|
| 0 297 691 | 1/1989 | (EP) . |
| 0 704 624 | 4/1996 | (EP) . |
| 5-36640 | 5/1993 | (JP) . |
| 7-103162 | 4/1995 | (JP) . |
| WO 91/09230 | 6/1991 | (WO) . |
| WO 94/29597 | 12/1994 | (WO) . |
| WO 97/28372 | 8/1997 | (WO) . |

* cited by examiner

*Primary Examiner*—Charles G. Freay
(74) *Attorney, Agent, or Firm*—Evenson, McKeown, Edwards & Lenahan, P.L.L.C.

(57) ABSTRACT

A low pressure-side first-stage compressor impeller and a high pressure-side second-stage compressor impeller are mounted respectively on opposite ends of a rotation shaft. A rotor of an electric motor for driving the two impellers is formed at a central portion of the rotation shaft. A stator of the motor is held by a motor casing. The motor casing, a first-stage compressor casing, which cooperates with the first-stage compressor impeller to form a first-stage compressor, and a second-stage compressor casing, which cooperates with the second-stage compressor impeller to form a second-stage compressor, are cast into an integral construction. This integral casing is further formed integrally with an intermediate cooler, disposed downstream of the first-stage compressor, and a discharge cooler disposed downstream of the second-stage compressor. The intermediate cooler and the discharge cooler are disposed below the motor casing in generally parallel relation to the rotation shaft, and the main portions of the two-stage centrifugal compressor are combined into a compact, generally rectangular parallelepiped configuration.

9 Claims, 8 Drawing Sheets

TWO-STAGE CENTRIFUGAL COMPRESSOR

BACKGROUND OF THE INVENTION

This invention relates to a two-stage centrifugal compressor in which compressor impellers are mounted directly on a motor shaft.

Japanese Patent Examined Publication No. 5-36640 discloses a two-stage centrifugal compressor, used in a plant or a factory, in which in order to achieve a compact design of the two-stage centrifugal compressor, impellers are mounted respectively on opposite ends of a shaft of an electric motor, and are driven directly without the use of any speed increaser. In the centrifugal compressor disclosed in this publication, a compressor casing, having a discharge scroll, is separate from a motor casing having a motor stator and bearings mounted therein. A downstream side of the discharge scroll is connected to a pipe through a flange. Each of first and second compressor stages has an suction portion for drawing gas in an axial direction, and is connected to an suction pipe through a flange.

In order to achieve a compact design of a centrifugal compressor, there has also been proposed the type of centrifugal compressor in which a compressor casing, an intermediate cooler and a discharge cooler are formed integrally with one another. One such example is disclosed in Japanese Patent Unexamined Publication No. 7-103162. The compressor, disclosed in this publication, comprises two parallel rotation shafts (that is, a low-speed shaft and a high-speed shaft) disposed at the same height, and the two shafts are connected together through a speed-increasing gear (speed increaser). A housing of the speed-increasing gear, is vertically divided into two portions (that is, upper and lower portions) at a horizontal plane including centerlines (axes) of the two shafts. The lower housing is formed integrally with a cooler and so on, and the upper housing is removable. Flanges for mounting a motor thereon are formed respectively on one ends of the upper and lower housings, and the coaxial relation between the low-speed shaft and the motor is secured through this flange.

In the centrifugal compressor, disclosed in Japanese Patent Examined Publication No. 5-36640, the compact design of the apparatus can be achieved. However, the compressor casing and the motor casing are separate from each other, and the number of the component parts, including those interconnecting the two casings, is increased, and therefore machining or working errors and assembling errors for the parts are accumulated during the assembling operation, which leads to a possibility that in a bearing-holding portion inside a stator, the coaxial relation between a rotor and the stator, as well as the precision of axial positioning of the rotor and the stator, is lowered. In the case where magnetic bearings and impellers without a shroud are used in order to achieve the more compact design of the centrifugal compressor disclosed in this publication, it is difficult to keep the positional relation between the rotor and the stator within a predetermined allowable range, although it is necessary to accurately position the rotor and the stator with respect to each other. Therefore, in order to enhance the assembling precision, if the parts are more accurately positioned by fitting portions, or if the parts are fixedly positioned by knock pins or the like, the assembling time and the machining time are increased, and the advantageous effects, such as the reduction of the cost by the compact design and the enhanced reliability, are adversely affected.

And besides, the centrifugal compressor, disclosed in this publication, is connected to the pipe through the flange at the downstream side of the discharge scroll of each compressor stage, and not only the first-stage compressor but also the second-stage compressor draw the gas in the axial direction, and are connected to the pipe through the flange, and the arrangement of pipes between the compressor and a cooler is inevitably complicated. Therefore, despite the fact that the impellers are mounted directly on the motor shaft, the advantageous effect, obtained with the space-saving design of the package compressor, including the cooler, can not be fully achieved. Incidentally, the compressor body and the cooler are different from each other in the amount of thermal deformation during the operation, and therefore there are possibilities that the air-tightness is lowered by the thermal deformation, and that a leakage results therefrom.

The centrifugal compressor, disclosed in Japanese Patent Unexamined Publication No. 7-103162, is the two-shaft compressor having the speed-increasing gear, and no consideration is given to a construction in which the motor is disposed coaxially with the rotation shaft of the compressor, and the impellers are driven directly without the use of any speed-increasing gear in order to achieve the compact design of the centrifugal compressor.

SUMMARY OF THE INVENTION

With the above problems of the prior art in view, it is an object of this invention to provide a centrifugal compressor having impellers mounted directly on a motor shaft, in which the assembling precision of the centrifugal compressor is enhanced, and the assembling operation can be carried out easily.

Another object of the invention is to provide a centrifugal compressor having impellers mounted directly on a motor shaft, which has a compact design.

A further object of the invention is to provide a centrifugal compressor in which the number of component parts is reduced so that the compressor can be manufactured at low costs.

A still further object of the invention is to provide a centrifugal compressor of a compact design in which the machining precision can be easily enhanced.

According to a first aspect of the present invention, there is provided a two-stage centrifugal compressor comprising:

- two centrifugal impellers mounted respectively on opposite ends of a rotation shaft to form two compressor stages;
- an electric motor portion for directly driving the two impellers, the motor portion being formed at a central portion of the rotation shaft;
- a motor casing covering the motor portion; and
- compressor casings covering the compressor stages, respectively;
- wherein the motor casing and the compressor casings are cast into an integral construction to form an integral casing.

Preferably, an intermediate cooler is provided between the compressor stages, and a discharge cooler is provided downstream of the downstream-side compressor stage, and a shell of the two coolers is formed integrally with the integral casing.

According to a second aspect of the invention, there is provided a two-stage centrifugal compressor comprising:

- two centrifugal impellers mounted respectively on opposite ends of a rotation shaft to form first and second compressor stages;
- an electric motor portion for directly driving the two impellers, the motor portion being formed at a central portion of the rotation shaft;

first and second compressor casings covering the first and second compressor stages, respectively;

the first compressor casing, the motor casing and the second compressor casing being disposed sequentially in a direction of an axis of the rotation shaft;

an intermediate cooler which is provided between the first and second compressor stages, and is disposed obliquely below the axis of the rotation shaft in generally parallel relation to the rotation shaft; and a discharge cooler which is disposed obliquely below the rotation shaft in generally parallel relation to the intermediate cooler, and communicates with one of the two compressor stages;

wherein the motor casing, the first compressor casing, the second compressor casing, a shell of the intermediate cooler and a shell of the discharge cooler are cast into an integral construction to form an integral casing.

Preferably, a flange is formed at each end of the intermediate cooler, and a flange is formed at each end of the discharge cooler, and four lid members, which are substantially identical in shape, are secured to the flanges, respectively.

According to a third aspect of the invention, there is provided a two-stage centrifugal compressor comprising:

two centrifugal impellers mounted respectively on opposite ends of a rotation shaft to form first and second compressor stages;

an electric motor portion for directly driving the two impellers, the motor portion being formed at a central portion of the rotation shaft;

an integral casing covering the motor portion and the two compressor stages;

an intermediate cooler portion extending from the integral casing to be disposed obliquely below the integral casing;

a discharge cooler portion extending from the integral casing to be disposed obliquely below the integral casing, the discharge cooler portion being generally parallel to the intermediate cooler portion;

a first duct portion communicating the first compressor stage with the intermediate cooler portion, the first duct portion being disposed at an upper side of the intermediate cooler portion and at a lower side of the first compressor stage;

a second duct portion communicating the second compressor stage with the intermediate cooler portion, the second duct portion being disposed at the upper side of the intermediate cooler portion and at a lower side of the second compressor stage; and a third duct portion communicating one of the two compressor stages with the discharge cooler portion, the third duct portion being disposed at an upper side of the discharge cooler portion and at the lower side of the one compressor stage.

According to a fourth aspect of the invention, there is provided a two-stage centrifugal compressor comprising:

a rotation shaft;

a first-stage centrifugal impeller mounted on one end of the rotation shaft;

a second-stage centrifugal impeller mounted on the other end of the rotation shaft;

an electric motor portion for directly driving the two impellers, the motor portion being formed at a central portion of the rotation shaft;

an integral casing covering a first-stage compressor portion including the first-stage centrifugal impeller, a second-stage compressor portion including the second-stage centrifugal impeller, and the motor portion; and a suction passage portion for flowing operating gas into the first-stage impeller in a direction from a position, disposed radially outwardly of the compressor, toward an axis of the rotation shaft.

Preferably, a collector is formed at an outlet portion of the first-stage compressor portion adjacent to the first-stage impeller, and a cross-sectional area of the collector in a cross-section parallel to the rotation shaft is substantially uniform in a circumferential direction. Preferably, two radial magnetic bearings, rotatably supporting the rotation shaft, are provided between the first-stage and second-stage centrifugal impellers, and a thrust magnetic bearing is provided between the two radial magnetic bearings, and grooves are formed circumferentially in an inner peripheral surface of the integral casing, and cooling passages, communicating the grooves with the bearings, are formed in the compressor stages. Preferably, a first head cover member, which closes an end of the integral casing close to the first-stage impeller, and forms a suction passage leading to the first-stage impeller, is removably mounted on the integral casing, and a second head cover member, which closes an end of the integral casing close to the second-stage impeller, and forms a suction passage leading to the second-stage impeller, is removably mounted on the integral casing.

In the centrifugal compressor of the present invention which is driven directly by the motor, there may be adopted an arrangement in which the intermediate cooler and the discharge cooler are formed integrally with the compressor body, including the motor casing, and are disposed beneath this compressor body, and the outer peripheral portions of the casings of the compressor body are disposed in contact with the upper surfaces of the coolers, thereby reducing the outer size of the compressor.

DESCRIPTION OF THE PREFERRED EMBODIMENTS

Several preferred embodiments of the present invention will now be described with reference to the drawings.

Figure 1:
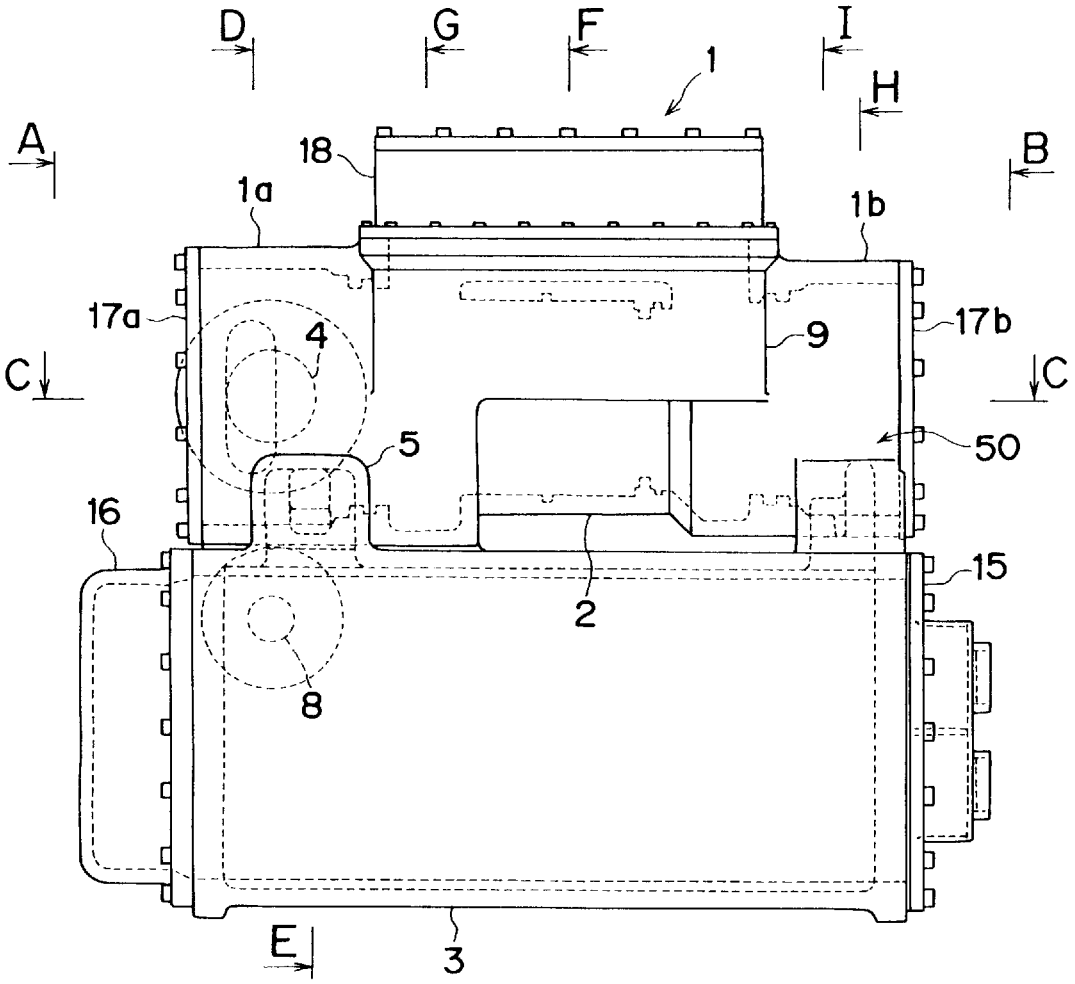
FIG. 1 is a front-elevational view of a first embodiment of a two-stage centrifugal compressor of the present invention.
Figure 2:
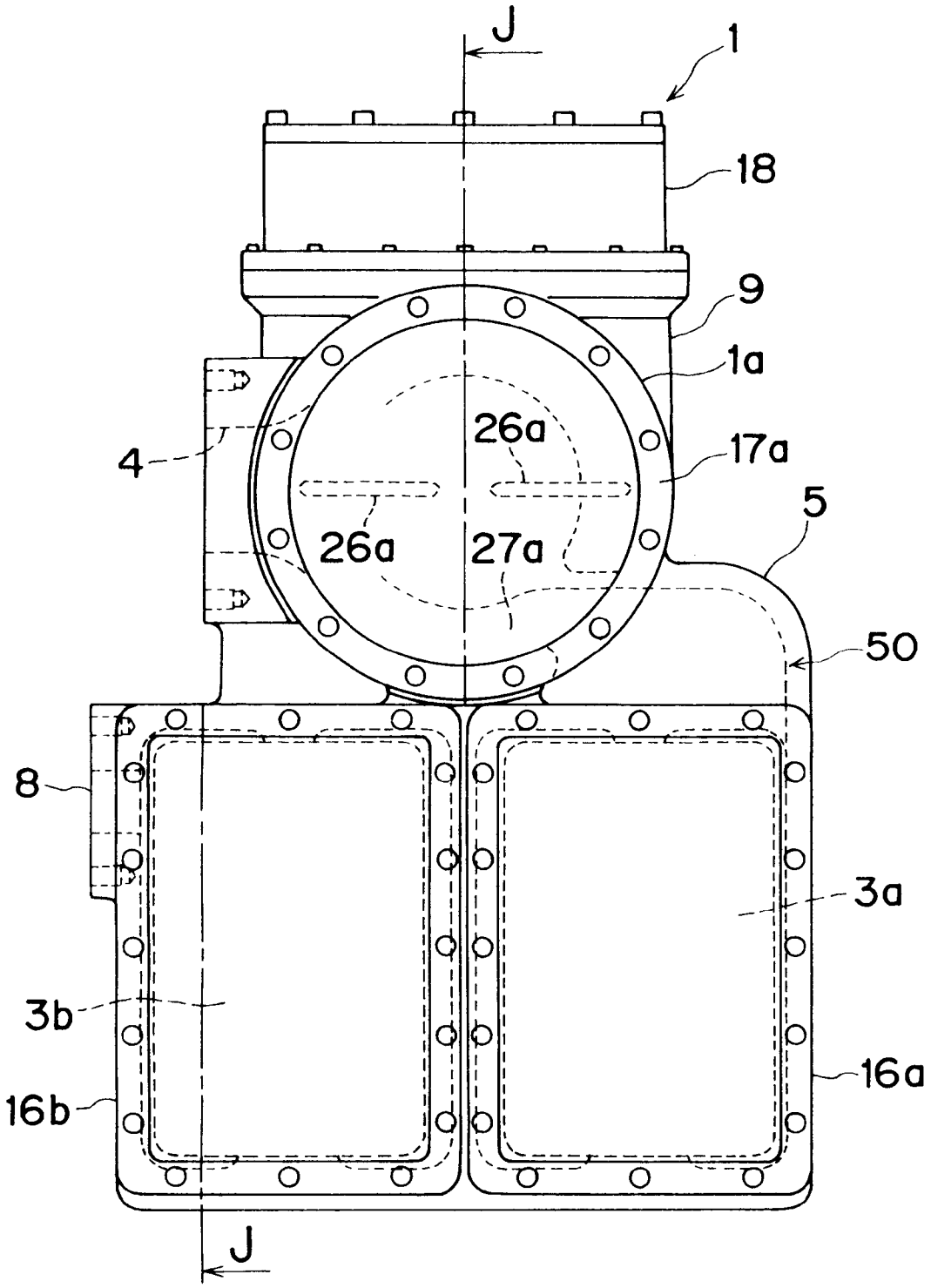
FIG. 2 is a side-elevational view of the first embodiment of FIG. 1.
Figure 3:
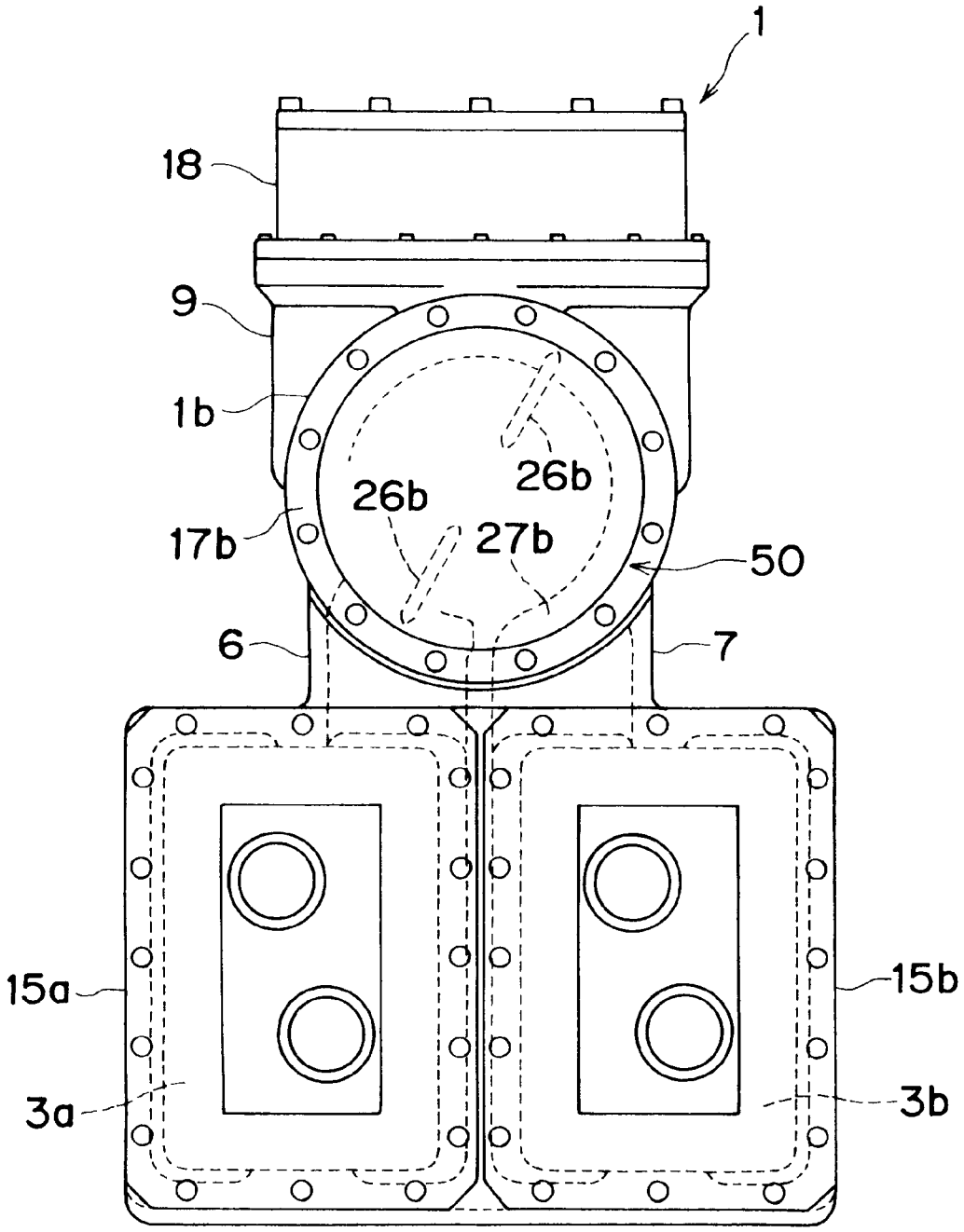
FIG. 3 is a side-elevational view of the first embodiment of FIG. 1.

FIGS. 1 to 9 show a first embodiment of a two-stage centrifugal compressor of the present invention, and FIG. 1 is a front-elevational view showing the appearance of the two-stage centrifugal compressor, FIG. 2 is a side-elevational view as seen in a direction of arrow A of FIG. 1, and FIG. 3 is a side-elevational view as seen in a direction of arrow B of FIG. 1. In the centrifugal compressor 1 of this embodiment, a motor casing 2, holding a stator of an electric motor for driving impellers of the compressor, and a first-stage compressor casing 1*a* and a second-stage compressor casing 1*b* (each having a stator portion of the compressor), which are provided respectively on opposite sides of the motor casing 2, are formed integrally with one another. An intermediate cooler 3*a* and a discharge cooler 3*b* are provided below this integral casing 50, and casings of the two coolers 3*a* and 3*b* are formed integrally with the casing body 50 including the motor casing 2 and the compressor casings 1*a* and 1*b*.

Figure 4:
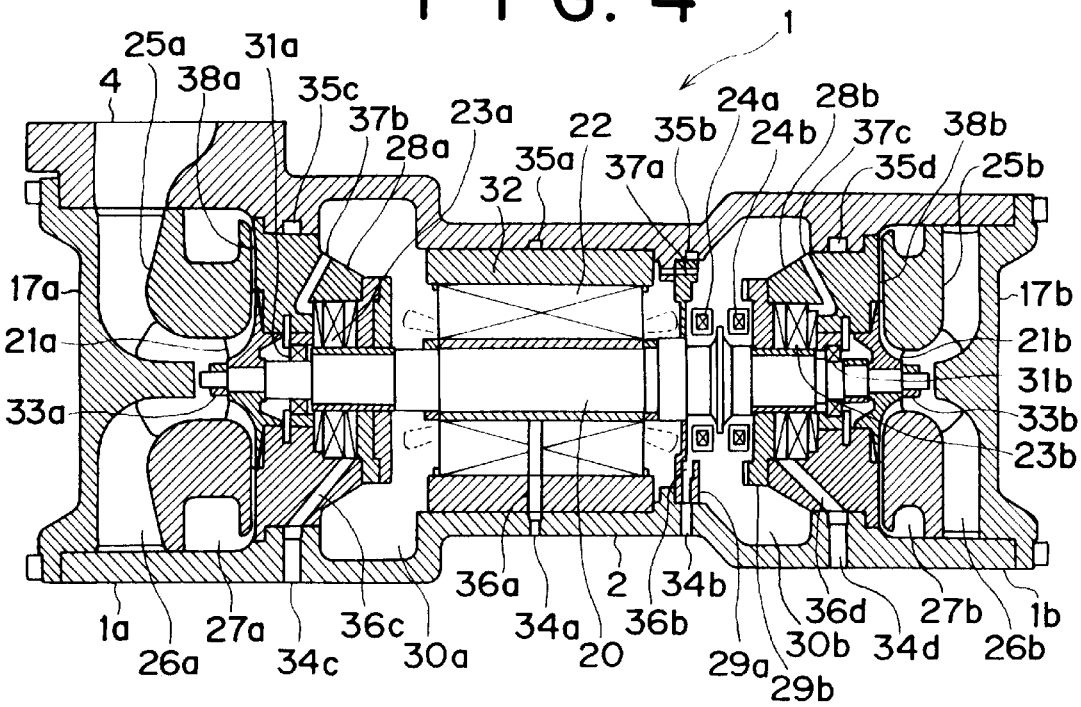
FIG. 4 is a longitudinal cross-sectional view of the first embodiment of FIG. 1, showing details of the interior of the compressor.

As shown in FIG. 4 which is a cross-sectional view taken along the line C—C of FIG. 1, in the two-stage compressor of the invention, the first- and second-stage centrifugal impellers 21*a* and 21*b* are mounted directly on opposite ends of a rotation shaft 20 of the motor, respectively.

The rotation shaft 20 is rotatably supported by radial magnetic bearings 23*a* and 23*b* provided inwardly respectively of the two impellers 21*a* and 21*b* on the rotation shaft 20. Axial magnetic bearings 24*a* and 24*b* for supporting an axial thrust, produced by this two-stage compressor, are provided axially inwardly of the right radial bearing 23*b* (FIG. 4) of the second-stage compressor in such a manner that a thrust plate, mounted on the rotation shaft 20, is interposed between the two axial magnetic bearings 24*a* and 24*b*. The radial bearings 23*a* and 23*b* are fixed respectively to bearing housings 28*a* and 28*b*, and the axial magnetic bearings 24*a* and 24*b* are fixed respectively to bearing holders 29*a* and 29*b*.

A motor rotor portion is mounted on a generally central portion of the rotation shaft 20, and the motor stator 22 is disposed in surrounding relation to this rotor portion, with a small gap formed therebetween. The motor stator 22 is held by a stator housing 32, and the stator housing 32 is held by the motor casing 2.

The centrifugal impellers 21*a* and 21*b*, directly mounted respectively on the opposite ends of the rotation shaft 20, are open shroud impellers without a shroud wall, and a small gap is formed between a shroud surface of each of the impellers 21*a* and 21*b* and an inner casing 25*a*, 25*b*. The impellers 21*a* and 21*b* are fastened to the rotation shaft 20 by respective nuts 33*a* and 33*b*, and can be removed from the rotation shaft 20.

Auxiliary bearings 31*a* and 31*b* are provided axially outwardly of the radial magnetic bearings 23*a* and 23*b*, respectively, and these auxiliary bearings 31*a* and 31*b* prevent the rotor from contacting the stator portion and the casings when the magnetic bearings are in a de-energized condition as during the assembling operation and when the compressor is stopped. During the operation of the compressor, the rotation shaft 20 is floated by the magnetic bearings 23*a* and 23*b*, and is rotated without contact with the auxiliary bearings 31*a* and 31*b*. A gap, formed between each of the auxiliary bearings 31*a* and 31*b* and the rotation shaft 20 during the operation, is smaller than an air gap in the motor, an air gap in the magnetic bearings 23*a* and 23*b* and a shroud gap in the impellers.

Next, an operating gas compression system of the compressor will be described. In the first-stage compressor (shown at the left side in FIG. 4), operating (working) gas is drawn into a first-stage suction nozzle 4, and flows through an suction passage having a current plate 26*a*, and is compressed by the first-stage impeller 21*a*. The compressed operating gas is recovered in pressure by a diffuser 38*a* provided at the downstream side of the impeller 21*a*, and then is collected by a collector 27*a*, and is fed to the second-stage compressor. The diffuser 38*a* is formed by the inner casing 25*a* and the bearing housing 28*a* which also form the suction passage. In many cases, a diffuser with blades or vanes is used as the diffuser 38*a*, but a diffuser without blades may be used. The diameter of an outlet of the diffuser 38*a* is sufficiently larger than the outer diameter of the impeller 21*a*, and the flow of the operating gas from the impeller 21*a* is sufficiently decelerated. The inner casing 25*a* is mounted on a compressor head cover 17*a* through the current plate 26*a*. By securing the head cover 17*a* to an outer end of the first-stage casing 1*a* by bolts through a seal member, the suction passage of the first-stage compressor is formed.

The discharge collector 27*a* is formed by the inner casing 25*a* and the first-stage compressor casing 1*a*. Unlike a scroll (in which a flow passage area varies in a circumferential direction), the collector 27*a* has a flow passage area constant in a circumferential direction, and therefore the recovery of the static pressure in the collector 27*a* is not expected. However, the gas, flowing into the collector 27*a*, has been sufficiently decelerated by the upstream diffuser 38*a*, and therefore even if the cross-sectional area of the collector 27*a* is large, the flow can be decelerated without causing an undue loss. And besides, as compared with a flow in a scroll, the flow in the collector 27*a* is subjected to a less static pressure change in the circumferential direction, and a radial fluid force, acting on the compressor rotor including the impeller, is small, and noises and vibrations can be kept to a low level. With the use of the collector, there is achieved an advantage that the above various desirable characteristics can be obtained at other operating point than the design point of the compressor.

The operating gas, collected in the collector 27*a*, flows into an suction passage of the second-stage compressor via a passage described later. This second-stage compressor is similar in construction to the first-stage compressor. More specifically, the operating gas flows through the suction passage having a current plate 26*b*, and is further compressed by the second-stage impeller 21*b*. The compressed operating gas is recovered in pressure by a diffuser 38*b* provided at the downstream side of the impeller 21*b*, and then is collected by a collector 27*b*, and is fed to a site of demand via the discharge cooler 3*b*. The diffuser 38*b* is formed by the inner casing 25*b* and the bearing housing 28*b* which also form the suction passage. The inner casing 25*b* is mounted on a compressor head cover 17*b* through the current plate 26*b*. By securing the head cover 17*a* to an outer end of the second-stage casing 1*b* by bolts through a seal member, the suction passage of the second-stage compressor is formed. The diffuser 38*b* may be one with or without blades as described above for the first-stage compressor.

Next, the passage of the operating gas and the cooling system in the two-stage compressor will be described. The operating gas, drawn into the first-stage suction nozzle 4, passes through the passage in the first-stage compressor, and flows into a first-stage discharge duct 5 which also serves as a discharge nozzle and as a conduit leading to the intermediate cooler. The operating gas, flowed from the discharge duct 5, flows into the intermediate cooler 3*a*, disposed obliquely below the rotation shaft 20 in generally parallel relation thereto, and is cooled through heat exchange with cooling water or the like, and then flows into a second-stage suction duct 6. The operating gas, flowed into the second-stage suction duct 6, is fed to a second-stage discharge duct 7 via the passage in the second-stage compressor. The operating gas, flowed from the discharge duct 7, flows into the discharge cooler 3*b* disposed obliquely below the rotation shaft 20 in generally parallel relation to the intermediate cooler 3*a*, and in this discharge cooler 3*b*, the operating gas is adjusted to a temperature required by the final demand site, and then is fed from a discharge port 8, provided in a side surface of the discharge cooler 3*b*, to the demand site via an auxiliary equipment, such as a check valve, provided at the request of the customer or in view of safety. Therefore, a flange, to which such auxiliary equipment is connected, is formed at the discharge port portion 8. The intermediate cooler 3*a* and the discharge cooler 3*b* have substantially the same size, and are substantially symmetrical in shape with respect to a vertical plane including the centerline (axis) of the rotation shaft 20.

The first-stage suction nozzle 4 has a flange surface parallel to the rotation shaft 20, and an suction gas pipe, led from auxiliary equipment provided upstream of the two-stage compressor, is connected to the first-stage suction nozzle 4 through a flange. The suction nozzle 4 draws the operating gas in a direction from a position disposed radially outwardly of the compressor, and by doing so, the pre-revolution of the operating gas, which lowers the pressure head, is prevented. The first-stage discharge duct 5 is formed integrally with the first-stage compressor casing 1*a* and the intermediate cooler 3*a*, and the second-stage suction duct 6 and the second-stage discharge duct 7 are formed integrally with the intermediate cooler 3*a* and the discharge cooler 3*b*, respectively.

A nest of the heat exchanger is contained in each of the intermediate cooler 3*a* and the discharge cooler 3*b*, and as shown in FIG. 3, cooler head covers 15*a* and 15*b* are secured respectively to one ends of the intermediate and discharge coolers 3*a* and 3*b* close to the second-stage compressor through respective seal members, and hold the heat exchanger nests therein. Also, as shown in FIG. 2, end covers 16*a* and 16*b* are secured respectively to the other ends of the two coolers 3*a* and 3*b* close to the first-stage compressor through respective seal members. The relative position between the head cover 15 and the end cover 16 has no relation to the construction of the compressor. Namely, the head covers may be provided respectively at those ends of the two coolers close to the first-stage compressor whereas the end covers may be provided respectively at those ends of the two coolers close to the second-stage compressor. If the head covers 15 of the coolers 3*a* and 3*b* have the same configuration as that of the end covers 16, the heat exchanger nest of an identical configuration can be put into each cooler from either of the opposite ends of each cooler, and this increases the degree of freedom of the assembling operation.

The intermediate cooler 3*a* and the discharge cooler 3*b* are different from each other in the amount of the gas, passing therethrough, and the required heat exchange amount. Therefore, the two coolers have heretofore been designed to have their respective necessary sizes and configurations. On the other hand, in the present invention, the two coolers have the same size, and a common casting mold, common nests and common covers are used, and by doing so, the costs, including the parts-producing cost and the assembling cost, can be reduced.

A box-like outer wall 9 is formed on the integral casing 50, and covers the motor casing 2 of the casing 50, and a flange of a generally rectangular shape is formed on an upper edge of the outer wall 9, and a terminal box 18 is secured to this flange. Signal cables and power cables, connected to the motor and the magnetic bearings, are passed through wiring spaces 30*a* and 30*b* formed respectively in the compressor casings, and are led to the terminal box 18. The spaces 30*a* and 30*b* are made as wide as possible so as to facilitate the installation of the cables.

In this embodiment having the above-mentioned construction, the compressor, including the drive portion of the motor, can be assembled and disassembled in the direction of the axis of the rotation shaft 20. Namely, the motor casing 2 and the compressor casings 1*a* and 1*b* are formed as an integral cast product of a generally cylindrical shape, and therefore it is not necessary to use the conventional method in which the casing is divided at the largest diameter portion, and the flanges are formed respectively on the division surfaces. In this embodiment, the inner peripheral surface of the casing can be processed or machined in a continuous manner, using a machining center or the like, and the manufacture is easy, and the enhanced machining (or working) precision and the reduced manufacturing cost can be achieved. And besides, with the use of this integral casing, the amount of the adjusting operation, such as the centering, during the assembling operation, can be reduced. In the first-stage compressor, the suction nozzle 4 is provided at the outer peripheral surface of the casing, and the gas is drawn in the direction from the position disposed radially of the compressor, and therefore spaces for the installation of the various equipments are available at the sides of the compressor body. Therefore, the auxiliary equipments, such as an suction throttle valve and an suction filter, which are usually provided upstream of the first-stage compressor, can be mounted at the sides of the compressor body. When effecting the maintenance (e.g. cleaning) of the impeller 21*a*, the impeller can be removed from the compressor casing merely by removing the compressor head cover 17*a* and the inner casing 25*a* integrally connected thereto, without the need for removing the above auxiliary equipments, and therefore the maintenance operation can be carried out in an energy-saving manner.

In the compressor 1, heat is generated mainly by a copper loss and a core loss (iron loss) in the motor stator 22 and a windage loss due to the high-speed rotation of the rotating member. The temperature of the operating gas is raised to about 150° C. during the time when the pressure of the operating gas is increased by the impellers. However, the temperatures, at which the motor and the magnetic bearings are used, must be kept to below about 120° C. so as to ensure the insulating properties of coils. Therefore, cooling gas is fed from the exterior of the compressor 1 into the interior of this compressor 1. Inlet ports 34*a*, 34*b*, 34*c* and 34*d* for this cooling gas are provided in the outer peripheral portions of the motor casing 2 and the compressor casings 1*a* and 1*b* in the circumferential direction. The inlet ports 34*a*, 34*b*, 34*c* and 34*d* communicate respectively with cooling gas distribution grooves 35*a*, 35*b*, 35*c* and 35*d* formed in the inner peripheral surfaces of the casings in the circumferential direction. The cooling gas is fed from the cooling gas distribution grooves 35*a*, 35*b*, 35*c* and 35*d* to cooling gas supply passages 36*a*, 36*b*, 36*c* and 36*d* provided in the circumferential direction, thereby cooling the various heat-generating portions. The cooling gas distribution grooves 35*a*, 35*b*, 35*c* and 35*d* do not always need to be formed in the inner surfaces of the casings. For example, the distribution groove 35*a*, formed in the motor casing, may be formed in the outer peripheral portion of the motor stator housing 32. The cooling gas, after cooling those portions in the vicinity of the heat-generating portions, passes through discharge passages 37*a*, 37*b*, 37*c* and 37*d* provided in the circumferential direction, and is collected in the cable installation spaces 30*a* and 30*b*, and then reaches the terminal box 18. The provision of only one discharge port in the outer wall 9 or the terminal box 18 suffices. In this embodiment, the number of pipes necessary for the supply and discharge of the cooling gas can be reduced to a minimum. Only one discharge pipe with a large bore is needed, and a pressure loss in the discharge pipe is reduced, so that the pressure, at which the cooling gas is supplied, can be reduced.

Figure 5:
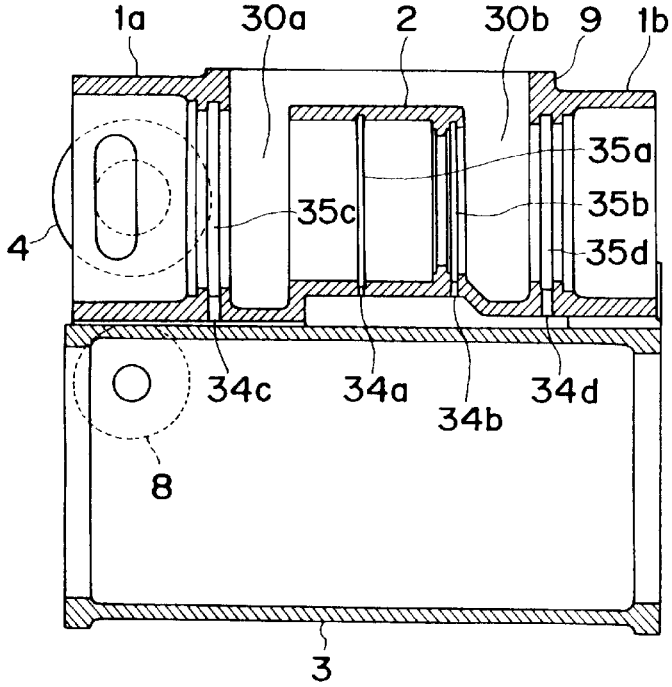
FIG. 5 is a longitudinal cross-sectional view of the first embodiment of FIG. 1, showing the details of the interior of a casing of the compressor.
Figure 6:
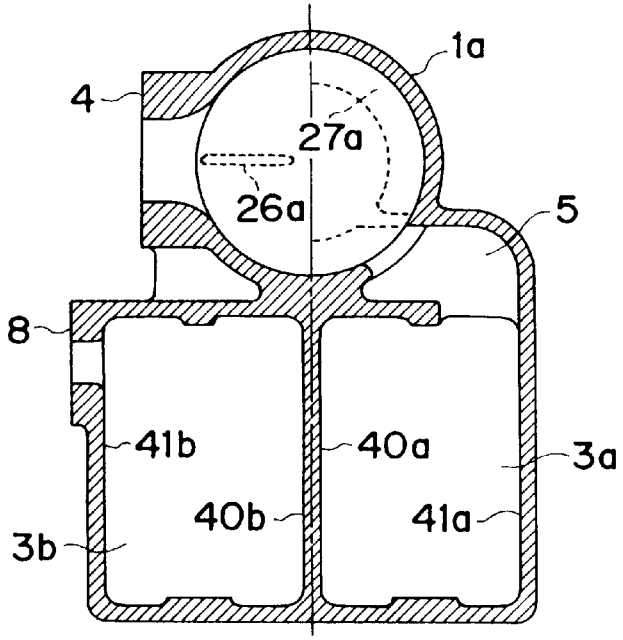
FIG. 6 is a transverse cross-sectional view of the first embodiment of FIG. 1, showing the details of the interior of the casing of the compressor.
Figure 7:
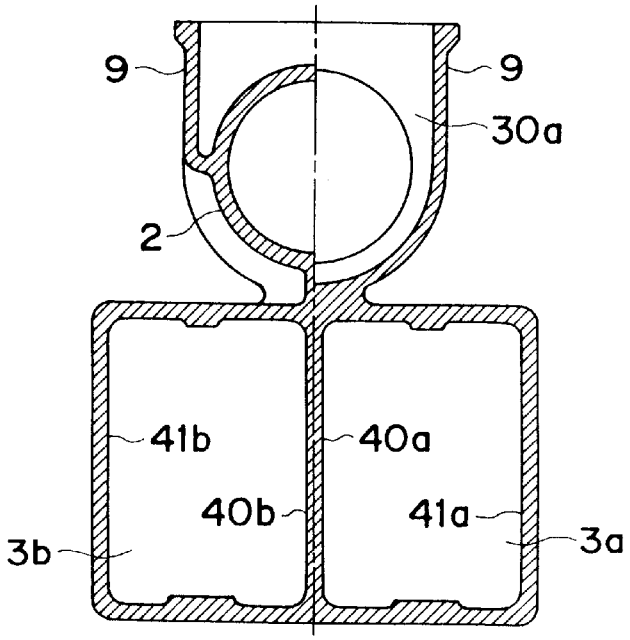
FIG. 7 is a transverse cross-sectional view of the first embodiment of FIG. 1, showing the details of the interior of the casing of the compressor.
Figure 8:
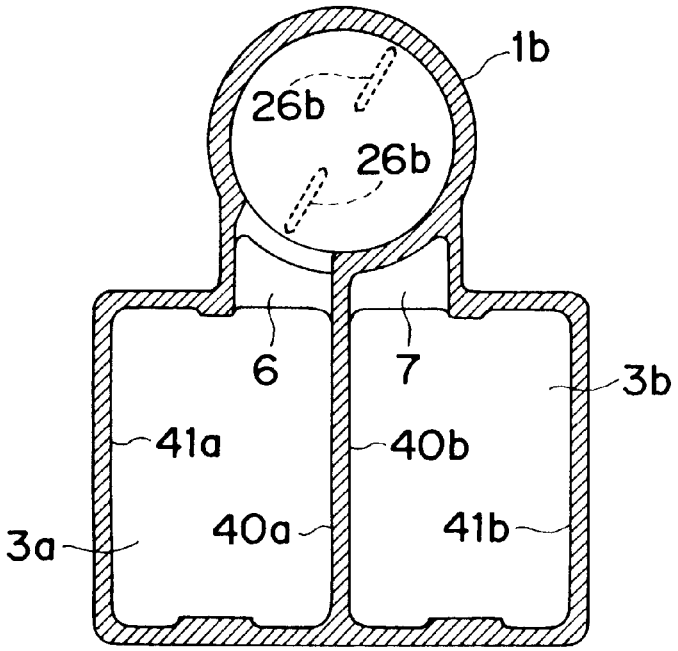
FIG. 8 is a transverse cross-sectional view of the first embodiment of FIG. 1, showing the details of the interior of the casing of the compressor.
Figure 9:
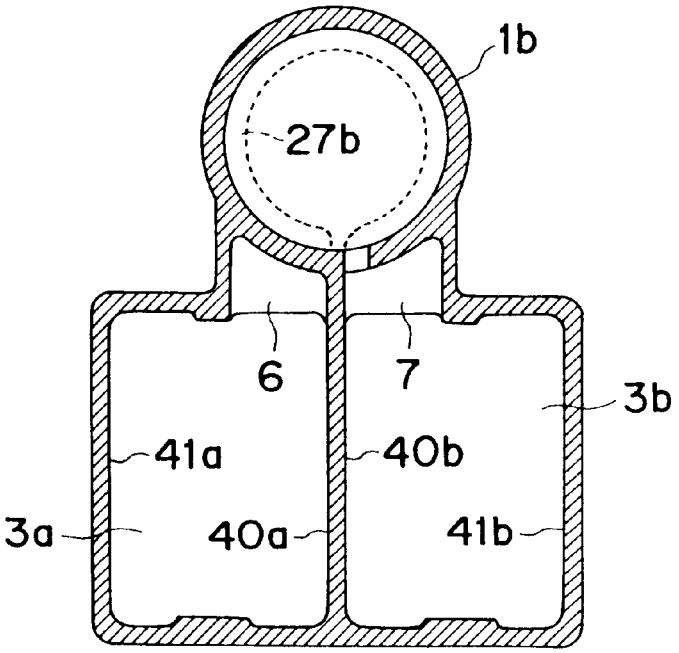
FIG. 9 is a transverse cross-sectional view of the first embodiment of FIG. 1, showing the details of the interior of the casing of the compressor.

Next, the detailed construction of the casing of the compressor of this embodiment will be described with reference to FIGS. 5 to 9. FIG. 5 is a cross-sectional view taken along the line J—J of FIG. 2, and FIG. 6 (left half portion) is a view as seen in a direction of arrow D of FIG. 1, and also FIG. 6 (right half portion) is a view as seen in a direction of arrow E of FIG. 1. FIG. 7 (left half portion) is a view as seen in a direction of arrow F of FIG. 1, and also FIG. 7 (right half portion) is a view as seen in a direction of arrow G of FIG. 1. FIG. 8 is a view as seen in a direction of arrow H of FIG. 1, and FIG. 9 is a view as seen in a direction of arrow I of FIG. 1. In FIGS. 6, 8 and 9, the discharge collectors, formed respectively by the inner casings 25*a* and 25*b*, and the current plates 26*a* and 26*b*, are shown in broken lines.

The casing of the compressor 1 includes the first-stage compressor casing 1*a*, the second-stage compressor casing 1*b*, the motor casing 2, the intermediate cooler casing 3*a* and the discharge cooler casing 3*b*, and these casings are made of, for example, cast iron, cast ductile iron, cast steel or the like and are cast into an integral construction. This integral casing is symmetrical in its transverse cross-section.

With this casing of the integral construction, those parts (such as bolts, nuts and pipes), heretofore used to connect the casings together, are unnecessary, and the number of the component parts is greatly reduced. And besides, the cylindrical inner surface of the compressor body can be machined in a continuous manner, and by doing so, the high coaxial precision can be achieved, and the centering of the motor casing relative to the compressor casing, and the machining for forming aligned knock holes, which have heretofore been required, are unnecessary. Furthermore, since the construction of the casing is generally symmetrical, the mating surface of the mold can be disposed in a plane, including the axis of symmetry, when casting the casing. Namely, the mold can be generally symmetrical with respect to a plane including the centerline (axis) of the rotation shaft 20 and a partition wall 40 separating the intermediate cooler and the discharge cooler from each other, and the mold, which can be made, for example, of wood or sand, can be produced easily.

The integral cast casing has an advantage that the rigidity of the casing can be increased, and another advantage is that the damping characteristics are excellent since cast iron is used. With the two advantages, the low-vibration and low-noise design of the compressor can be achieved. Furthermore, since the outer surface area of the casing can be reduced, the sound, radiating from the outer surface of the casing, can be reduced. Namely, a speed-increasing gear, which has heretofore created the main source of generation of vibrations and noises, does not need to be provided, and the casing is cast into the integral construction, and with this construction, the advantages obtained by the drive system in which the impellers are mounted directly on the motor shaft, can be fully enjoyed.

The casing of the compressor body is generally cylindrical, and the outer diameter of the first-stage compressor casing 1*a* is the largest. The first-stage compressor is disposed in such a manner that its outer peripheral surface is generally in contact with the upper surface of the cooler at the largest diameter portion thereof. Namely, the height (or distance) from the upper surface of the cooler to the rotation shaft of the compressor is generally equal to the largest outer diameter of the casing of the compressor body. By thus providing the compressor body in proximity to the cooler, the gas passages, communicating the compressor body with the coolers, can be formed in the integral casing having the compressor casing and the cooler shell formed integrally with each other.

This compact arrangement of the equipments can be achieved by the facts that any speed-increasing gear is not provided and that the impellers are mounted directly on the motor shaft. Comparing this with the above-mentioned prior art techniques, an outer diameter of a low-speed gear of the speed-increasing gear in the conventional construction is much larger than the outer diameter of the compressor casing, and when the high-speed shaft and the low-speed shaft are disposed at the same height, it is difficult to arrange the compressor and the cooler close to each other. In this embodiment, the compact design of the apparatus can be effected quite easily as described above. The connection between the compressor body and the cooler is achieved not by bolts or the like as used in the conventional construction, but by the integral cast product, and therefore a gas leakage, developing in the pipe-connected portion because of the thermal deformation, is prevented.

The compressor body casing and the cooler shell are constituted by the integral cast product, and the first-stage discharge duct 5, the second-stage suction duct 6 and the second-stage discharge duct 7 are formed integrally on the integral casing so that the operating gas can flow through the first-stage compressor, the intermediate cooler, the second-stage compressor and the discharge cooler. The outer walls of these ducts serve to support the compressor casing. In this embodiment, the distance between the compressor body and the cooler is made as short as possible to thereby reduce the overall size of the compressor, and also ribs are suitably provided on the casing to obtain the adequate rigidity.

In this embodiment, the walls of the ducts serve also as leg portions of the compressor, and a sufficient space for the ducts is not available, and for these reasons the configuration of the ducts do not necessarily provide the optimum passages from the viewpoint of fluid dynamics. However, the discharge gas in the compressor is sufficiently decelerated before it reaches the collector portion, and a loss, developing in the duct portion, is relatively small, and the space-saving effect, achieved by the ducts also serving as the leg portions, is marked. The intermediate cooler 3*a* and the discharge cooler 3*b* have a generally rectangular cross-section, and have sufficient rigidity and stability to support the compressor body. Therefore, there is no need to provide any base beneath the cooler 3, and therefore the compact two-stage centrifugal compressor can be obtained. If the partition wall 40, separating the discharge cooler and the intermediate cooler from each other, is shifted toward the discharge cooler, the volume ratio of the discharge cool to the intermediate cooler can be made optimum from the view-point of fluid dynamics. In this case, the discharge cooler has no excessive volume, and the apparatus can be formed into a more compact design. In this example, also, if the center of the width of the two coolers in a direction perpendicular to the rotation shaft coincides with the center of the rotation shaft in the direction of the width, the integral casing of a stable construction can be obtained.

The motor casing 2 is not connected to the compressor casings 1*a* and 1*b* over the entire periphery thereof, but is formed integrally with the compressor casings 1*a* and 1*b* only at a generally lower half of the periphery thereof. Upper half portions of the compressor casings 1*a* and 1*b*, which are not connected directly to the motor casing 2, are connected to the box-like outer wall 9. The outer wall 9 forms a sufficiently-wide space which generally surrounds the periphery of the motor casing, and communicates with the cable installation spaces 30*a* and 30*b*. As described above, easy access to the cable lead-out portion is obtained, and the efficiency of the cable connection operation, effected when assembling the compressor, is enhanced.

Figure 10:
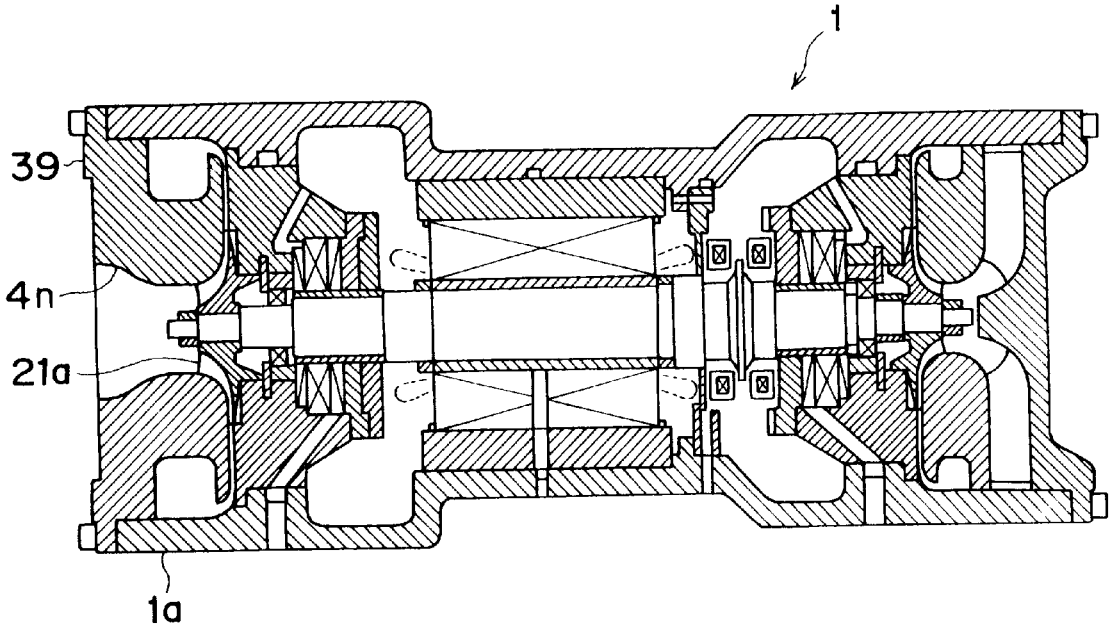
FIG. 10 is a longitudinal cross-sectional view of a second embodiment of a two-stage centrifugal compressor of the invention, showing details of the interior of the compressor.

Next, a second embodiment of a two-stage centrifugal compressor of the invention will be described with reference to FIG. 10. This embodiment differs from the first embodiment in that the direction of drawing of the operating gas in a first-stage compressor is a direction of an axis of a rotation shaft. The other construction is generally the same as described above for the first embodiment shown in FIGS. 1 to 9. Namely, in the second embodiment, a suction nozzle 4*n*, having a flange surface perpendicular to the rotation shaft, is formed in a suction casing 39. In this second embodiment, auxiliary equipments, such as a suction throttle valve and a suction filter, need to be provided forwardly of the rotation shaft of the compressor.

The operating gas is drawn in the direction of the axis of the rotation shaft, and by doing so, the construction of the compressor is more simplified, and the axial length of the first-stage compressor can be reduced. A long straight passage is provided upstream of a first-stage impeller 21*a*, and therefore the distribution of flow of the operating gas into the impeller 21*a* is improved, thereby enhancing the efficiency of the compressor. With respect to a second-stage compressor, the operating gas can be drawn in the direction of the axis as in the first-stage compressor.

Figure 11:
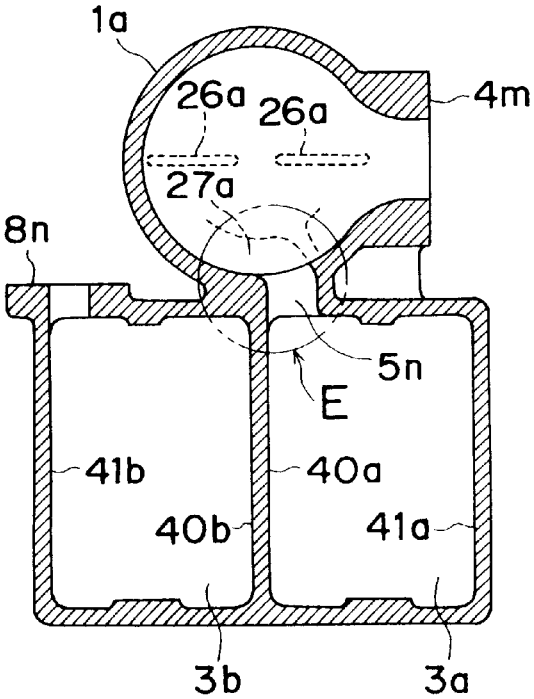
FIG. 11 is a longitudinal cross-sectional view of a third embodiment of a two-stage centrifugal compressor of the invention, showing details of the interior of a casing of the compressor.
Figure 12:
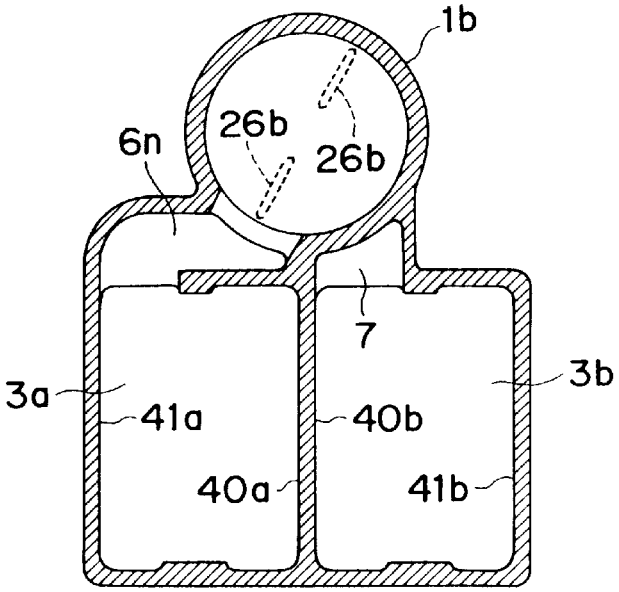
FIG. 12 is a transverse cross-sectional view of the third embodiment, showing the details of the interior of the casing of the compressor.

A third embodiment of a two-stage centrifugal compressor of the invention will be described with reference to FIGS. 11 and 12. FIG. 11 is a view similar to the view as seen in the direction of arrow D of FIG. 1, and that portion of FIG. 11 encircled by a dots-and-dash line is a view similar to the view as seen in the direction of arrow E of FIG. 1. FIG. 12 is a view similar to the view as seen in the direction of arrow H of FIG. 1. This embodiment differs from the first embodiment in the arrangement of nozzles and ducts, and the other construction is generally the same as described above for the first embodiment.

Discharge gas is fed from a first-stage compressor to an intermediate cooler 3*a* through a discharge duct 5*n*, and in contrast with the first embodiment, this discharge gas flows into the intermediate cooler 3*a* so as to flow along a wall surface 40*a* of the intermediate cooler 3*a* disposed adjacent to a discharge cooler 3*b*. The gas, cooled by the intermediate cooler 3*a*, is fed into a suction duct 6*n* along a wall surface 41*a* remote from the discharge cooler 3*b*, and is drawn generally radially into a second-stage compressor 1*b*. In this embodiment, a suction nozzle 4*m* of the first-stage compressor does not interfere with a discharge passage 5*n*, and therefore the suction nozzle 4*m* can be disposed adjacent to the intermediate cooler 3*a*, that is, at a position turned 180 degrees from the position of the intermediate cooler in the first embodiment. And besides, since a discharge port 8*n* of the discharge cooler 3*b* does not interfere with the suction nozzle 4*m*, the discharge port 8*n* can be provided at an upper wall of the discharge cooler 3*b*. Furthermore, with respect to the position of the suction nozzle 4*m*, it can be arranged in a desired direction in so far as it does not interfere with the structural members such as the coolers. Namely, the equipments of the compressor can be freely arranged although this arrangement is limited by the arrangement of auxiliary equipments such as a suction throttle valve and a suction filter, and therefore the more compact two-stage centrifugal compressor of the package type can be achieved.

In the first embodiment, a wall surface 40*a* of the intermediate cooler 3*a* is in contact with the gas of a generally ordinary temperature cooled by the intermediate cooler 3*a*, and a wall surface 40*b* of the discharge cooler 3*b* is in contact with the discharge gas of high temperature from the second-stage compressor. On the other hand, in this embodiment, the opposite sides (that is, wall surfaces 40*a* and 40*b*) of the partition wall 40 are both in contact with the discharge gas of the compressor, and the temperature difference between the opposite sides of the partition wall 40 is small. Therefore, in this embodiment, the amount of transfer of heat through the partition wall 40 is reduced, and the lowering of the efficiency due to the temperature rise of the suction gas for the second-stage compressor is suppressed, and also a thermal stress due to the temperature difference between the opposite sides of the partition wall 40 can be reduced.

Figure 13:
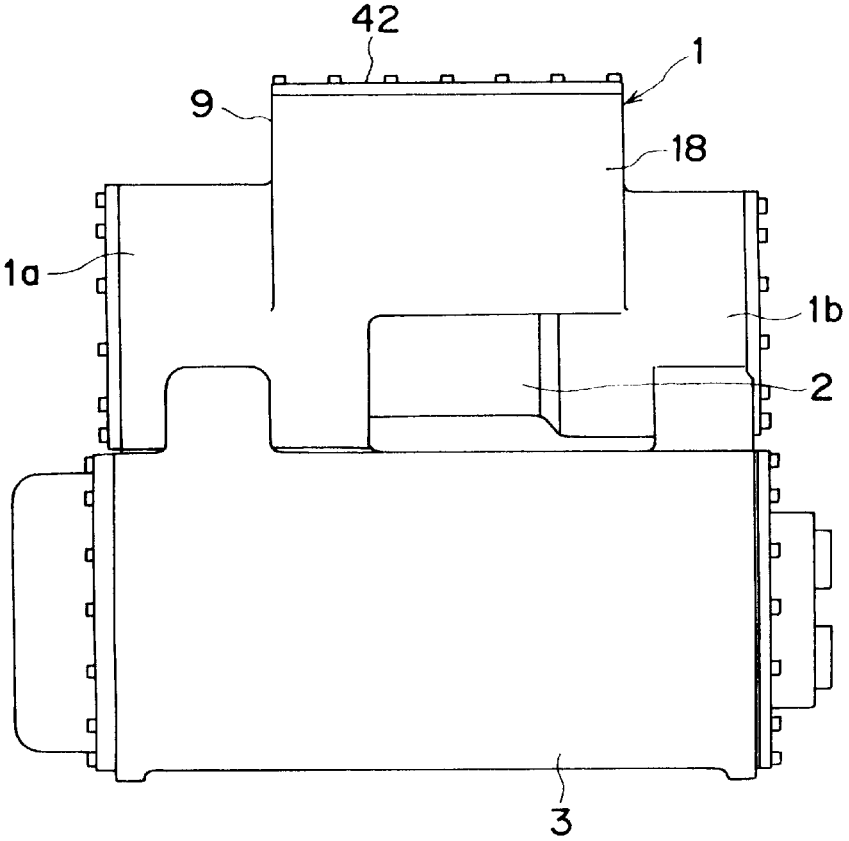
FIG. 13 is a front-elevational view of a fourth embodiment of a two-stage centrifugal compressor of the invention.

Next, a fourth embodiment of the present invention will be described with reference to FIG. 13.

In this embodiment, a box-like outer wall 9, formed on an upper portion of a compressor, is extended upwardly to form a terminal box 18. Namely, the terminal box 18 is cast integrally with compressor casings 1*a* and 1*b* and the motor casing 2, and therefore the number of the component parts, including bolts and the like, can be reduced, and therefore the manufacturing cost and the assembling cost can be reduced. In this embodiment, the terminal box 18 is formed integrally with the compressor body, and merely by removing an upper lid 42, a generally rectangular opening can be obtained. Therefore, cables for a motor and magnetic bearings can be easily installed.

In the above 1st to 4th embodiments, although the magnetic bearings are used, slide bearings or roller bearings may be used. In short, any construction, in which the compressor casings 1*a* and 1*b*, the motor casing 2, the coolers 3*a* and 3*b* and so on are formed into the integral construction so as to achieve the compact design of the compressor and the low-noise and low-vibration design, falls within the scope of the invention.

As described above, in the two-stage centrifugal compressors of the present invention, the rotor of the motor is mounted on the central portion of the rotation shaft, and the centrifugal impellers are mounted respectively on the opposite ends of this rotation shaft, and the impellers are driven directly by the motor, and there is provided the integral casing which covers the motor portion and the two compressor stages. Therefore, there is no need to use a speed-increasing gear, and the size of the apparatus can be reduced.

And besides, since the compressor casings and the motor casing are formed into the integral construction, the time and labor required for the assembling operation, as well as the number of the component parts, are reduced, and the positioning of the compressor stages with respect to the motor portion becomes quite easier, and the reduction of the costs and the enhancement of the reliability can be achieved.

What is claimed is:

1. A two-stage centrifugal compressor comprising:

two centrifugal impellers mounted respectively on opposite ends of a rotation shaft to form upstream-side and downstream-side compressor stages;

an electric motor portion for directly driving said two impellers, said motor portion being formed at a central portion of said rotation shaft;

a motor casing covering said motor portion; and compressor casings covering said compressor stages, respectively;

wherein said motor casing and said compressor casings are cast into an integral construction to form an integral casing, an intermediate cooler is provided between said compressor stages, and a discharge cooler is provided downstream of the downstream-side compressor stage, and a shell of said two coolers is formed integrally with said integral casing.

2. A two-stage centrifugal compressor comprising:

two centrifugal impellers mounted respectively on opposite ends of a rotation shaft to form first and second compressor stages;

an electric motor portion for directly driving said two impellers, said motor portion being formed at a central portion of said rotation shaft;

first and second compressor casings covering said first and second compressor stages, respectively;

said first compressor casing, said motor casing and said second compressor casing being disposed sequentially in a direction of an axis of said rotation shaft;

an intermediate cooler which is provided between said first and second compressor stages, and is disposed obliquely below the axis of said rotation shaft in generally parallel relation to said rotation shaft; and a discharge cooler which is disposed obliquely below said rotation shaft in generally parallel relation to said intermediate cooler, and communicates with one of said two compressor stages;

wherein said motor casing, said first compressor casing, said second compressor casing, a shell of said intermediate cooler and a shell of said discharge cooler are cast into an integral construction to form an integral casing.

3. A compressor according to claim 2, in which a flange is formed at each end of said intermediate cooler, and a flange is formed at each end of said discharge cooler, and four lid members, which are substantially identical in shape, are secured to said flanges, respectively.

4. A compressor according to claim 2, in which a first head cover member, which closes an end of said integral casing close to said first-stage impeller, and forms a suction passage leading to said first-stage impeller, is removably mounted on said integral casing, and a second head cover member, which closes an end of said integral casing close to said second-stage impeller, and forms a suction passage leading to said second-stage impeller, is removably mounted on said integral casing.

5. A two-stage centrifugal compressor comprising:

two centrifugal impellers mounted respectively on opposite ends of a rotation shaft to form first and second stages;

an electric motor portion for directly driving said two impellers, said motor portion being formed at a central portion of said rotation shaft;

an integral casing covering said motor portion and said two compressor stages;

an intermediate cooler portion extending from said integral casing to be disposed obliquely below said integral casing;

a discharge cooler portion extending from said integral casing to be disposed obliquely below said integral casing, said discharge cooler portion being generally parallel to said intermediate cooler portion;

a first duct portion communicating said first compressor stage with said intermediate cooler portion, said first duct portion being disposed at an upper side of said intermediate cooler portion and at a lower side of said first compressor stage;

a second duct portion communicating said second compressor stage with said intermediate cooler portion, said second duct portion being disposed at the upper side of said intermediate cooler portion and at a lower side of said second compressor stage; and a third duct portion communicating one of said two compressor stages with said discharge cooler portion, said third duct portion being disposed at an upperside of said discharge cooler portion and at the lower side of said one compressor stage wherein said motor casing, said first compressor casing, said second compressor casing, a shell of said intermediate cooler and a shell of said discharge cooler are cast into an integral construction to form an integral casing.

6. A two-stage centrifugal compressor comprising:

a rotation shaft;

a first-stage centrifugal impeller mounted on one end of said rotation shaft;

a second-stage centrifugal impeller mounted on the other end of said rotation shaft;

an electric motor portion for directly driving said two impellers, said motor portion being formed at a central portion of said rotation shaft;

an integral casing covering a first-stage compressor portion including said first-stage centrifugal impeller, a second-stage compressor portion including said second-stage centrifugal impeller, and said motor portion; a diffuser for the first-stage centrifugal impeller being comprised of a compressor head cover removably securable to the integral casing and an inner casing mounted on a compressor head cover through a current plate, a suction passage portion for flowing operating gas into said first-stage impeller in a direction from a position, disposed radially outwardly of said compressor, toward an axis of said rotation shaft; an intermediate cooler between said first-stage compressor portion and said second-stage compressor portion; a discharge cooler downstream of said second-stage compressor portion; and a shell of said two coolers formed integrally with said integral casing.

7. A compressor according to claim 6, in which a collector is formed at an outlet portion of said first-stage compressor portion adjacent to said first-stage impeller, and a cross-sectional area of said collector in a cross-section parallel to said rotation shaft is substantially uniform in a circumferential direction.

8. A compressor according to claim 6, in which two radial magnetic bearings, rotatably supporting said rotation shaft, are provided between said first-stage and second-stage centrifugal impellers, and a thrust magnetic bearing is provided between said two radial magnetic bearings, and grooves are formed circumferentially in an inner peripheral surface of said integral casing, and cooling passages, communicating said grooves with said bearings, are formed in said compressor stages.

9. A compressor according to claim 7, in which two radial magnetic bearings, rotatably supporting said rotation shaft, are provided between said first-stage and second-stage centrifugal impellers, and a thrust magnetic bearing is provided between said two radial magnetic bearings, and grooves are formed circumferentially in an inner peripheral surface of said integral casing, and cooling passages, communicating said grooves with said bearings, are formed in said compressor stages.

* * * * *